US008434240B2

(12) United States Patent
Thompson, Jr. et al.

(10) Patent No.: US 8,434,240 B2
(45) Date of Patent: May 7, 2013

(54) FREEZE DRYING METHOD

(75) Inventors: Taylor N. Thompson, Jr., Ulster Park, NY (US); Weijia Ling, Highland, NY (US)

(73) Assignee: Millrock Technology, Inc., Kingston, NY (US)

( * ) Notice: Subject to any disclaimer, the term of this patent is extended or adjusted under 35 U.S.C. 154(b) by 298 days.

(21) Appl. No.: 12/929,525

(22) Filed: Jan. 31, 2011

(65) Prior Publication Data

US 2012/0192447 A1 Aug. 2, 2012

(51) Int. Cl.
*F26B 5/06* (2006.01)
*F26B 13/30* (2006.01)

(52) U.S. Cl.
USPC ..... 34/285; 34/92; 34/284; 34/287; 34/292

(58) Field of Classification Search ..... 34/282, 34/292, 284
See application file for complete search history.

(56) References Cited

U.S. PATENT DOCUMENTS

| | | | | |
|---|---|---|---|---|
| 4,780,964 | A | 11/1988 | Thompson, Sr. | |
| 5,689,895 | A * | 11/1997 | Sutherland et al. | 34/92 |
| 5,948,144 | A | 9/1999 | Cifuni | |
| 5,964,043 | A | 10/1999 | Oughton et al. | |
| 6,122,836 | A | 9/2000 | Tenedini et al. | |
| 6,163,979 | A | 12/2000 | Oetjen et al. | |
| 6,176,121 | B1 | 1/2001 | Oetjen | |
| 6,226,887 | B1 | 5/2001 | Tenedini et al. | |
| 6,643,950 | B2 | 11/2003 | Lambert et al. | |
| 6,848,196 | B2 | 2/2005 | Brulls | |
| 6,931,754 | B2 | 8/2005 | Sennhenn et al. | |
| 6,971,187 | B1 * | 12/2005 | Pikal et al. | 34/285 |
| 2008/0098614 | A1 | 5/2008 | Tchessalov et al. | |

FOREIGN PATENT DOCUMENTS

| | | | |
|---|---|---|---|
| EP | 1 903 291 | A1 | 3/2008 |
| WO | WO 2007/116371 | A2 | 10/2007 |

OTHER PUBLICATIONS

Barresi, A., "Monitoring of the primary drying of a lyophilization process in vials," Chem.E and Processing, 2009, 408-414.*

(Continued)

*Primary Examiner* — Kenneth Rinehart
*Assistant Examiner* — Elizabeth Ayala
(74) *Attorney, Agent, or Firm* — Nixon & Vanderhye PC

(57) ABSTRACT

A method of controlling the primary drying stage in a freeze drying apparatus having a shelf and bulk product or a number of vials in different areas on the shelf which contain product to be freeze dried. Temperature sensors are positioned in selected locations or vials which are representative of the different bulk product areas or the positions of all of the vials in different areas of the shelf. The temperature sensors are monitored and compared to determine the selected location or vial having the highest temperature while the temperature sensor therein is still in ice. The shelf temperature is controlled based on the selected location or vial with the highest temperature so long as the temperature sensor therein is still in ice. When the temperature sensor in the highest temperature selected location or vial is no longer in ice, another selected location or vial with the highest temperature and a temperature sensor therein that is still in ice is then used to control the shelf temperature.

19 Claims, 2 Drawing Sheets

OTHER PUBLICATIONS

Willermer, H., "*Measurements of temperatures, ice evaporation rates and residual moisture contents in freeze-drying*," Dev. Biol. Stand. 1992, Abstract.

Milton, N., et al., "*Evaluation of Manometric Temperature Measurement as a Method of Monitoring Product Temperature During Lyophilization*," PDA Journal Pharm. Science, vol. 51, No. 1; Jan.-Feb. 1997 pp. 7-16.

Tang, X., et al., "*Freeze-Drying Process Design by Manometric Temperature Measurement: Design of a Smart Freeze-Dryer*," Pharmaceutical Research; vol. 22, No. 4; Apr. 2005; pp. 685-700.

Tang, X., et al., "*Evaluation of Manometric Temperature Measurement (MTM), a Process Analytical Technology Tool in Freeze Drying, Part III: Heat and Mass Transfer Measurement*," AAPS Pharm Sci, 2001.

* cited by examiner

FREEZE DRYING METHOD

BACKGROUND OF THE INVENTION

This invention relates generally to a freeze-drying process and, more particularly, to a system for optimizing control of a freeze-drying process to produce dry product that is presentable, fully reconstitutable and has a long shelf life.

DESCRIPTION OF THE BACKGROUND ART

Freeze-drying, also termed "lyophilization", is a drying process employed to convert solutions of materials into solids. A typical freeze-dryer comprises a "drying chamber" containing temperature controlled shelves which is connected to a "condenser chamber". The condenser chamber houses a series of plates or coils capable of being maintained at very low temperature (i.e., less than −50° C.). One or more vacuum pumps are connected to the condenser chamber to achieve pressures below the triple point of water and typically below 1000 mT Torr in the entire system during operation. A commercial freeze-dryer may have numerous shelves with a total capacity on the order of 50,000 or more vials. Small freeze dryers may have only one shelf.

The main objective of freeze drying equipment is to control the freeze drying process while keeping the product temperature below its critical temperature. The critical temperature is considered the temperature at which the product melts back or collapses. When the product temperature increases above its critical temperature the structure will no longer be able to maintain its physical structure and will fall back on to itself, resulting in an unacceptable cake. In addition, melt back or collapse can compromise shelf life and/or reconstitute-ability.

The freeze-drying process typically comprises three stages: the "freezing stage", the "primary drying stage" and the "secondary drying stage". In a typical freeze-drying process, an aqueous solution or product containing, for example, a drug and various formulation aids, or "excipients", is filled into glass vials, and the vials are loaded onto temperature-controlled shelves within the drying chamber.

After loading the product vials, the freezing stage is started. In the freezing stage most of the water in the product is converted into ice. During the freezing stage the shelf temperature is reduced, typically in several stages, to a temperature in the vicinity of −40° C., thereby converting nearly all of the water in the product into ice. Some excipients, such as buffer salts and mannitol, may partially crystallize during freezing, but most "drugs", particularly proteins, remain amorphous. The drug and excipients are typically converted into an amorphous glass containing large amounts of unfrozen water (15%-30%) dissolved in the solid (i.e., glassy) amorphous phase.

After most water and solutes have been converted into solids, the primary drying stage is started. In the primary drying stage, ice is removed from the product by direct sublimation. During the primary drying stage, the freeze dryer is evacuated by the vacuum pumps to the desired control pressure, the shelf temperature is increased to supply energy for sublimation, and primary drying begins. Due to the large heat flow required during the primary drying stage, the product temperature runs much colder than the shelf temperature. The removal of ice crystals from the product by sublimation creates an open network of "pores" which allows pathways for escape of water vapor out of the product. The ice-vapor boundary (i.e., the boundary between frozen and "dried" regions) generally moves from the top of the product toward the bottom of the vial as primary drying proceeds. Primary drying is normally the longest part of the freeze-drying process. Primary drying times on the order of days are not uncommon, and in rare cases, weeks may be required due to a combination of poor formulation and sub-optimal freeze-drying process design.

When a judgment is made that all vials are devoid of ice, the secondary drying stage is started. In the secondary drying stage most of the unfrozen water is removed from the material by desorption. During this stage the shelf temperature is typically increased to provide the higher product temperature required for efficient removal of unfrozen water. The final stages of secondary drying are normally carried out at shelf temperatures in the range of about 25° C. to about 50° C. over a period of up to several hours. Since the demand for heat is low in this stage, the shelf temperature and the product temperature are nearly identical.

Historically, due to the FDA requiring consistent and repeatable drying profiles, open loop control has been used to control the product temperature throughout the freeze drying run. The shelf temperature and vacuum levels are controlled at a level that assumes the product is kept below its critical temperature. There is no feedback from the product temperature to adjust the shelf temperature. The problem with this methodology is that the heat transfer dynamics of the freeze drying process change with time and the same shelf temperature and vacuum level will produce different product temperatures throughout the run. There are times when the shelf temperature can be raised to increase the drying rate and other times when the shelf temperature should be lowered to reduce the temperature of the product. Using open loop control requires a conservative process. Since the true product temperature is not measured and the heat transfer characteristics change throughout the run, the optimum shelf temperature is difficult to determine.

Freeze drying, in vials, progresses from the top surface of the product toward the bottom. The area where sublimation is taking place is called the sublimation interface or freeze drying front. As the product dries a dry region builds up which impedes vapor flow which changes the drying dynamics. The temperature of the product is affected by conduction, convection, and radiation heat transfer. These modes of heat transfer vary during the freeze drying process and throughout the freeze drying chamber. The highest temperature in a vial is at the bottom. The coolest temperature is at the sublimation front. A system of measurement needs to be in place to keep the highest temperature below the critical temperature. There are many methods for monitoring or measuring product temperatures, each with their advantages and disadvantages. Some methods are specific to a single vial while others measure the average for the batch.

One method known in the art uses in-process manometric temperature measurement (MTM) data and a control system to optimize the primary drying conditions. Manometric temperature measurement is a procedure by which the product temperature at the sublimation interface and the resistance of the previously dried product to vapor flow may be determined.

Briefly, in manometric temperature measurement a valve separating the drying chamber (and product) from the condenser chamber is quickly closed for a short time (for example, about 25 seconds). Pressure in the drying chamber is measured at intervals over the time that the valve is closed. The principle of manometric temperature measurement is based on the flow of water vapor from the product chamber to the condenser being momentarily interrupted during primary drying. During this perturbation of the drying process, the drying chamber pressure will rapidly increase due to the continued sublimation of ice. Since the composition of the vapor phase in the drying chamber is nearly all water vapor, sublimation will stop when the chamber pressure reaches the vapor pressure of ice at the sublimation interface, assuming that the ice temperature remains constant during the measurement. Measurement of this vapor pressure allows calculation of the product temperature at the sublimation front and resistance of the previously dried product to vapor flow at any time during primary drying.

The present MTM methods for optimizing a freeze drying run use pressure rise data to perform calculations and "expert assumptions" to estimate the shelf temperature and drying times. These methods provide a conservative result based on average batch parameters and are subject to the following disadvantages:

1. All measurements are batch based and conservative assumptions must be made to prevent local collapse or melt back;
2. Steady state heat transfer calculations are used to approximate dynamic conditions;
3. Many assumptions are made and not tested or measured, so that the result is a conservative run;
4. Control is still open-loop during the majority of the run and can only be applied for one-half to two-thirds of the drying cycle with the result that no adjustment is made to the shelf temperature for 30-50% of the primary drying cycle;
5. The act of closing the isolation valve to make the MTM measurements can create micro-collapse in the product; and
6. Normally the MTM method determines the end of primary drying as a pressure rise of less than 5 mT in 25 seconds, which will not work without a sufficient batch load.

Accordingly, a need has arisen for a new and improved method of optimizing the process for freeze drying a product. The method of the present invention meets this need.

BRIEF SUMMARY OF THE INVENTION

The method of the present invention is a closed loop freeze drying control method which uses the critical vial or critical bulk product temperature as a controlling point to insure that the entire batch of product is drying efficiently and safely. This is accomplished by a closed loop multi-point dynamic control method using the most critical vial of a sample group or critical point in a bulk product location to provide local information. The critical point dynamically changes from vial to vial or from different locations during a run depending on the drying progress of selected individual vials or locations being monitored. The control loop dynamically adapts to the drying front as the control point to insure the safety of the whole batch while maintaining the drying efficiency for the drying front.

Measuring a single vial or bulk product location does not provide sufficient information for closed loop control for the reason that vial or bulk product drying rates differ based on their location on the shelf. For example, the outside rows of the shelf dry faster than the middle of the shelf owing to radiation effects from the walls and front door. Also, shelf temperature uniformity results in temperatures lower at the fluid outlet than at the fluid inlet.

In accordance with the present method, suitable temperature sensing devices are positioned in selected vials or bulk product that are representative of vials or bulk product in different locations on a shelf, e.g., on the outside of the shelf, the inside of the shelf and the areas therebetween. The temperature sensing device used for control of the shelf temperature is the highest vial or bulk product temperature where the sensor is still reading the ice temperature. In accordance with this method, all of the sensors are monitored and compared to each other to determine the highest temperature vial or bulk product area. A pressure drop technique or other technique may be used to determine if the sensor is still in the ice. When the pressure drops, the ice temperature drops. If a sensor is no longer in ice, it is disabled and no longer used for control purposes. Another sensor that is still in ice in the next highest temperature vial or bulk product area is then used for controlling the shelf temperature. The temperature sensing devices may be of any suitable construction, such as a thermocouple, and are positioned at the bottom of each representative vial where the temperature is the highest or about one half way between the top surface of bulk product and the tray. It has been assumed that the presence of a temperature sensor in a vial or bulk product does not materially affect the freeze drying process.

The new and improved method of the present invention has the following advantages:

1. Optimized shelf temperature based on the warmest representative vial or bulk product area;
2. The measurement and control of the freeze drying process for a longer portion of primary drying than MTM by itself;
3. The measurement and control of smaller and larger batch sizes;
4. The elimination of many assumptions for controlling the freeze drying process;
5. Closed loop control of the shelf temperature;
6. There is no minimum load requirement—a single shelf of product can be used; and
7. It can be used on any size of freeze dryer from laboratory to production size.

In accordance with the present method, the primary drying cycle is terminated when it is determined that none of the temperature sensing devices is in ice in any of the representative vials or bulk product areas. Also, the following parameters may be measured to determine the end of primary drying in accordance with the knowledge of those skilled in the art:

1. Product Temperature>Shelf Temperature;
2. Pirani versus Capacitance Manometer Differential; and/or
3. Pressure rise<XmT in X period of time.

After the completion of the primary drying stage, the secondary drying stage will begin and may be accomplished in any suitable manner in accordance with presently known methods.

DETAILED DESCRIPTION OF THE INVENTION

Figure 1:
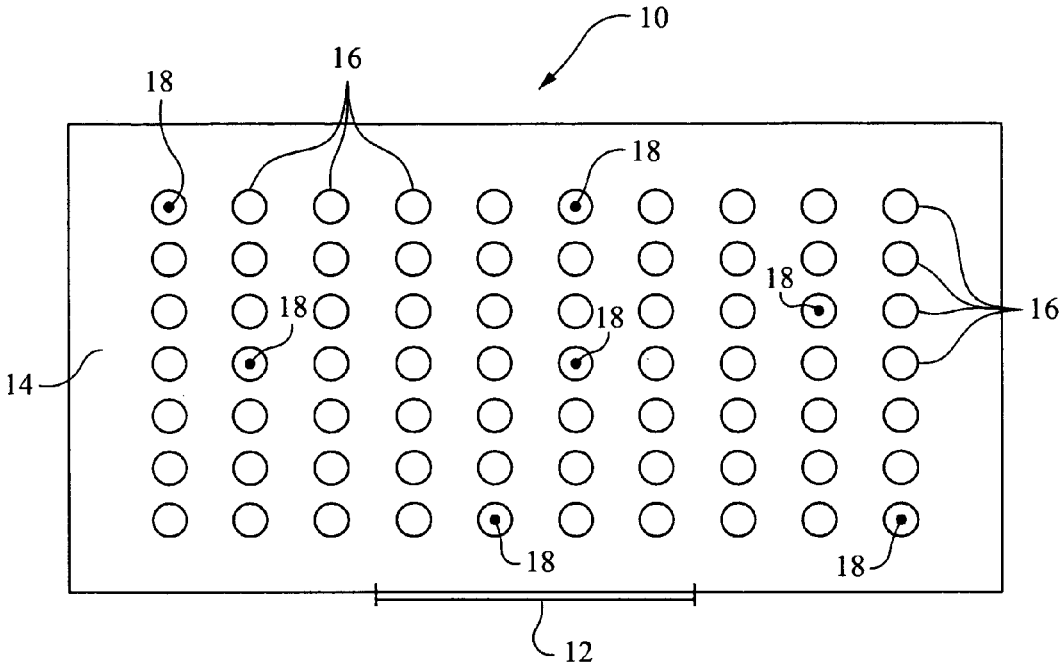
FIG. 1 is a plan view of vials of product to be freeze dried on the shelf of a freeze drying apparatus.

Referring to FIG. 1, a freeze drying apparatus 10 comprises a door 12 and a shelf 14 for supporting bulk product or a number of vials 16 containing product to be freeze dried. In accordance with the method of the present invention, temperature sensors 18 of any suitable type are positioned in selected vials 16 that are representative of the vials in different positions on the shelf, e.g., the front, the rear, the outside, the inside and the areas therebetween. An important aspect of the present invention is to provide the temperature sensors 18 in vials 16 that are representative of vials in different areas on the shelf 14 for the reason that vial drying rates differ based on a location of the vials 16 on the shelf. For example, the outside rows of the shelf 14 dry faster than the middle of the shelf owing to radiation effects from the walls and front door 12. Also, shelf temperature uniformity results in temperatures lower at the fluid outlet (not shown) than at the fluid inlet (not shown). Accordingly, temperature measurement in a single vial does not provide sufficient information for adequate closed loop control of the freeze drying process.

An important aspect of the critical vial control method of the present invention is to determine that the temperature sensor used for control of the shelf temperature is the highest vial temperature where the sensor is still reading the ice temperature. Accordingly, all of the sensors 18 are monitored in any suitable manner and compared to each other to determine the highest temperature vial. Different techniques may be used to determine if the sensor 18 in the highest temperature vial is still in ice. For example, a pressure drop test may be used. When the pressure drops, the ice temperature drops. Accordingly, if there is no change in temperature in response to a pressure drop, the sensor is no longer in ice. If a sensor 18 is no longer in ice, it is then disabled and no longer used for control purposes.

Thereafter, another sensor 18 that is in ice in a vial 16 having the highest temperature is then used for the control of the shelf temperature. In this manner, the optimized shelf temperature is based on the warmest vial having a temperature sensor 18 in ice therein. In this manner, the freeze-drying process is optimized to keep the product temperature below its critical temperature which is the temperature at which the product melts back or collapses.

The primary drying cycle is terminated when all of the sensors 18 in the critical or representative vials 16 are no longer in ice. This can be confirmed when the vacuum difference between two vacuum gauges, Capacitance Manometer vs Pirani, is within a range determined by a clean dry system being used. This may also be confirmed by a pressure rise test (pressure rise>XmT in X period of time).

Since freeze drying equipment is very expensive and process times are often long, a freeze dried product is relatively expensive to produce. Optimization of the freeze drying process, therefore, is critical to process efficiency, particularly during primary drying which is the longest stage of the process. Too low a product temperature yields an inefficient process and too high a product temperature will cause a loss of product quality. Development of optimum process conditions requires that the product temperature be maintained as high as possible, and yet below its critical temperature during primary drying. The new and improved critical vial control method of the present invention meets these conditions.

Figure 2:
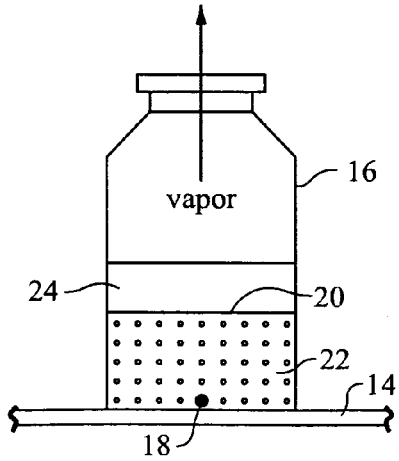
FIG. 2 is a side elevational view of a representative vial having product being freeze dried therein.

FIG. 2 illustrates a vial 16 on a product shelf 14 in a freeze drying apparatus. Freeze drying in a vial progresses from the top surface of the product toward the bottom. The area where sublimation is taking place is the sublimation interface or freeze drying front 20 between the frozen material 22 and the dry material 24. The temperature sensor 18 is located at the bottom of the vial 16 where the temperature is the highest.

Figure 3:
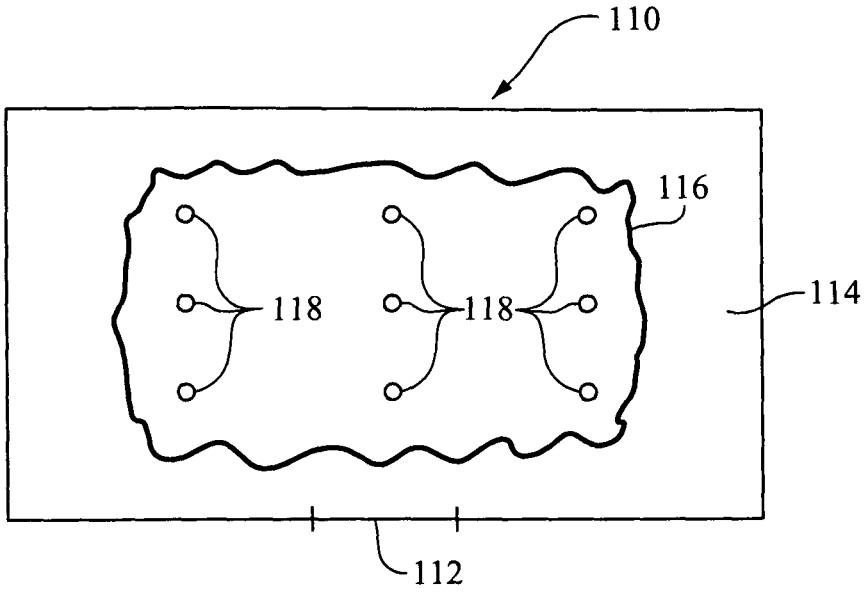
FIG. 3 is a plan view of bulk product to be freeze dried on the shelf of a freeze drying apparatus.

Referring to FIG. 3, in the case of bulk product 116 to be freeze dried on a shelf 114 of a freeze drying apparatus 110 having a door 112, temperature sensors 118 of any suitable type are positioned in different locations in the bulk product that follow the drying pattern, e.g., from the outside to the inside of the bulk product and from the outside area near the door 112 to the inside area of the bulk product 116.

Figure 4:
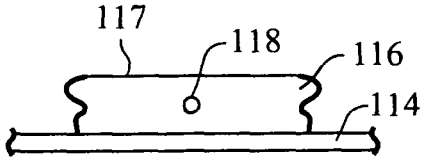
FIG. 4 is a partial side elevational view of the bulk product and shelf shown in FIG. 3.

In a manner similar to the vial control method, the temperature sensor 118 used for control of the shelf temperature is the one with the highest temperature where the sensor is still reading the ice temperature. Accordingly, all of the sensors 118 are monitored in any suitable manner and compared to each other to determine the sensor indicating the highest temperature. Since the drying in bulk material tends to occur from both the bottom and the top, the sensors 118 are positioned in the bulk product 116 about one half way between the top surface 117 and the shelf 114, as shown in FIG. 4.

Upon the completion of the primary drying stage, the secondary drying stage is started wherein most of the unfrozen water is removed from the material by desorption. In accordance with the present method, any known or conventional method or apparatus made by used for the secondary drying stage which is normally much shorter than the primary drawing stage.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of controlling the primary drying stage in a freeze drying apparatus having a shelf and a number of vials in different areas on the shelf which contain product to be freeze dried, comprising:

positioning temperature sensors in selected vials which are representative of the positions of all of the vials in different areas of the shelf, monitoring and comparing the temperature sensors to determine the selected vial having the highest temperature while the temperature sensor therein is still in ice, and controlling the shelf temperature based on the selected vial with the highest temperature so long as the temperature sensor therein is still in ice.

2. The method of claim 1 wherein the highest temperature selected vial is no longer used to control shelf temperature when the temperature sensor therein is no longer in ice, and another selected vial with the highest temperature and a temperature sensor therein that is still in ice is then used to control the shelf temperature.

3. The method of claim 1 wherein the temperature sensors are positioned in the bottom of the selected vials where the temperature is the highest.

4. The method of claim 3 wherein the temperature sensors are positioned in the center of the bottom of the selected vials.

5. The method of claim 1 wherein a pressure drop test is used to determine if a temperature sensor in a selected vial is still in ice.

6. The method of claim 1 wherein the number of selected vials is sufficient to represent vial temperatures in all areas of the shelf where vial temperatures may differ because of freeze drying process conditions or the construction of the freeze drying apparatus.

7. The method of claim 1 wherein the temperature sensors are thermocouples, wireless sensors or other temperature measurement devices that do not adversely affect the freeze drying process in the selected vials.

8. The method of claim 2 wherein the primary drying stage is close to completion when all of the temperature sensors in the selected vials are no longer in ice.

9. The method of claim 8 wherein the completion of the primary drying stage is confirmed by a predetermined vacuum difference between two vacuum gauges, Capacitance Manometer vs. Pirani.

10. The method of claim 8 wherein the completion of the primary drying stage is confirmed by testing the vapor pressure rise in the freeze drying apparatus.

11. A method of controlling the primary drying stage in a freeze-drying apparatus having a shelf and bulk product on the shelf to be freeze-dried, comprising:

positioning temperature sensors in selected locations in the bulk product which are representative of the drying pattern in different areas of the bulk product, monitoring and comparing the temperature sensors to determine the selected location having the highest temperature while the temperature sensor therein is still in ice, and controlling the shelf temperature based on the selected location with the highest temperature so long as the temperature sensor therein is still in ice.

12. The method of claim 11 wherein the highest temperature selected location is no longer used to control shelf temperature when the temperature sensor therein is no longer in ice, and another selected location with the highest temperature and the temperature sensor therein that is still in ice is then used to control the shelf temperature.

13. The method of claim 11 wherein the temperature sensors are positioned in the bulk product about one-half way between a top surface thereof and the shelf.

14. The method of claim 11 wherein a pressure drop test is used to determine if a temperature sensor in a selected location is still in ice.

15. The method of claim 11 wherein the number of selected locations is sufficient to represent bulk product temperatures in all areas of the shelf where bulk product temperatures may differ because of freeze-drying process conditions or the construction of the freeze-drying apparatus.

16. The method of claim 11 wherein the temperature sensors are thermocouples and/or wireless sensors that do not adversely affect the freeze-drying process in the selected locations.

17. The method of claim 12 wherein the primary drying stage is close to completion when all of the temperature sensors in the selected locations are no longer in ice.

18. The method of claim 17 wherein the completion of the primary drying stage is confirmed by a predetermined vacuum difference between two vacuum gauges, Capacitance Manometer vs. Pirani.

19. The method of claim 17 wherein the completion of the primary drying stage is confirmed by testing the vapor pressure rise in the freeze-drying apparatus.

* * * * *